US006293511B1

(12) United States Patent
Shepherd

(10) Patent No.: US 6,293,511 B1
(45) Date of Patent: Sep. 25, 2001

(54) SHEET MUSIC STAND

(75) Inventor: Charles G. Shepherd, Oakville (CA)

(73) Assignee: Petersen Designs INC, Calgary (CA)

( * ) Notice: Subject to any disclaimer, the term of this patent is extended or adjusted under 35 U.S.C. 154(b) by 0 days.

(21) Appl. No.: 09/504,096

(22) Filed: Feb. 15, 2000

Related U.S. Application Data

(63) Continuation-in-part of application No. 09/268,348, filed on Mar. 16, 1999, now abandoned.

(51) Int. Cl.[7] ..... A47B 97/04
(52) U.S. Cl. ..... 248/441.1; 248/461
(58) Field of Search ..... 248/441.1, 461, 248/170; 16/340

(56) References Cited

U.S. PATENT DOCUMENTS

| | | | |
|---|---|---|---|
| 347,124 | | 8/1886 | Oudin . |
| 645,527 | | 3/1900 | Latourell et al. . |
| 1,448,171 | | 3/1923 | Waderlow . |
| 1,768,810 | | 7/1930 | Walton . |
| 1,862,562 | | 6/1932 | Aldeen et al. . |
| 2,156,489 | | 2/1939 | Bonetti . |
| 2,474,532 | | 6/1949 | Kitchen . |
| 2,481,264 | | 9/1949 | Tulowiecki . |
| 3,031,247 | * | 4/1962 | Schieve ..... 248/461 |
| 4,610,417 | | 9/1986 | Kuss . |
| 5,037,057 | | 8/1991 | Andrews . |
| 5,078,353 | | 1/1992 | Linn . |
| 5,114,111 | | 5/1992 | Andrews . |
| 5,356,109 | | 10/1994 | Biasini . |
| 5,692,719 | | 12/1997 | Shepherd . |

FOREIGN PATENT DOCUMENTS 41 20 501 C1 6/1991 (DE) .

* cited by examiner

*Primary Examiner*—Alvin Chin-Shue
(74) *Attorney, Agent, or Firm*—Christopher R. Scott

(57) ABSTRACT

A collapsible stand of the type used to display sheet music for a musician is provided. The stand has a music support and a hinge attached to the music support for connecting the music support to a base having a telescopic post and legs releasably attached to the post. The music support includes rectangular first and second platens which can be moved about the axis of the hinge between an open position in which they are co-planar to support music in a closed position to define a cavity for containing the base after it has been disassembled.

7 Claims, 7 Drawing Sheets

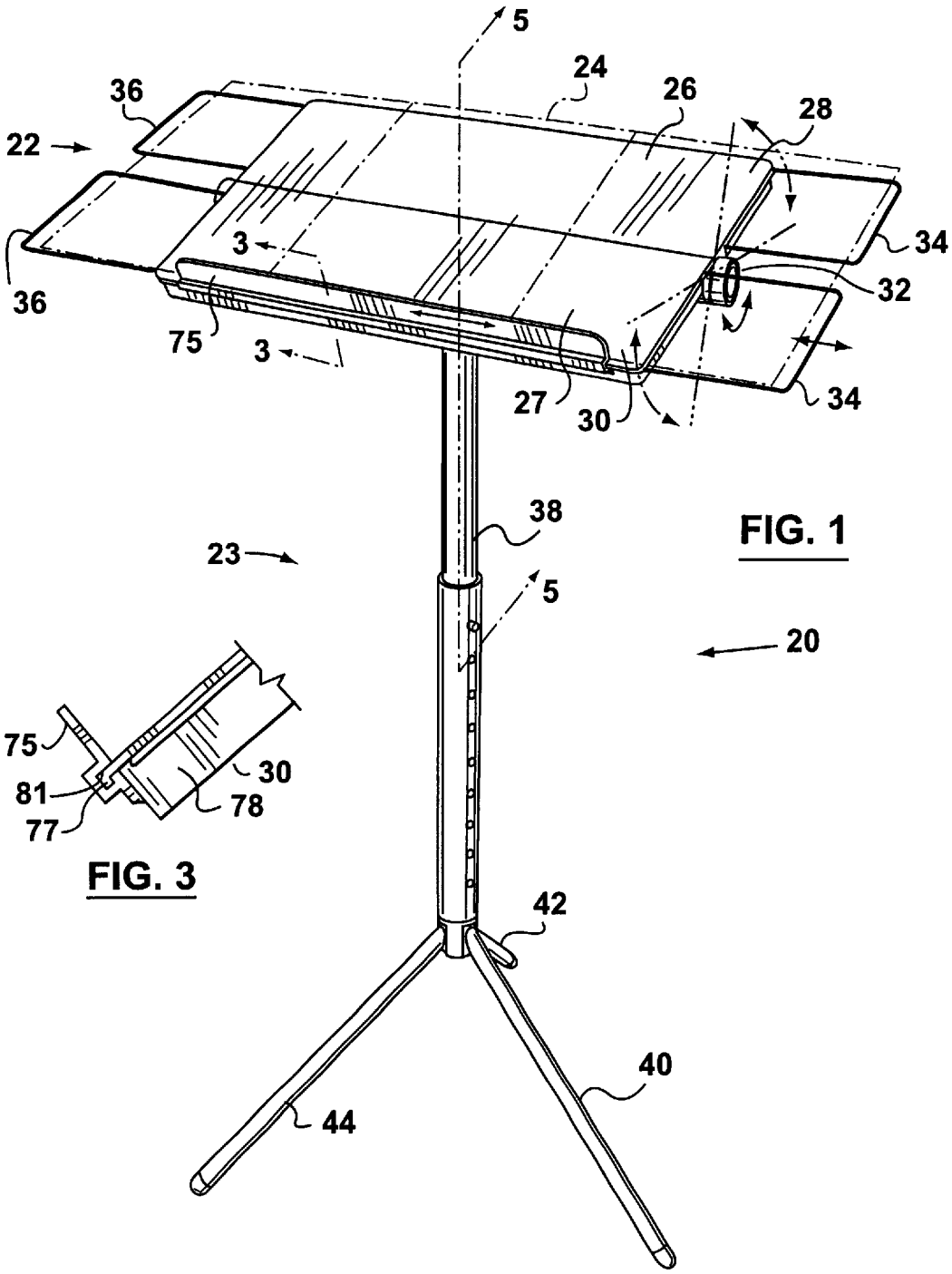
FIG. 1
FIG. 3
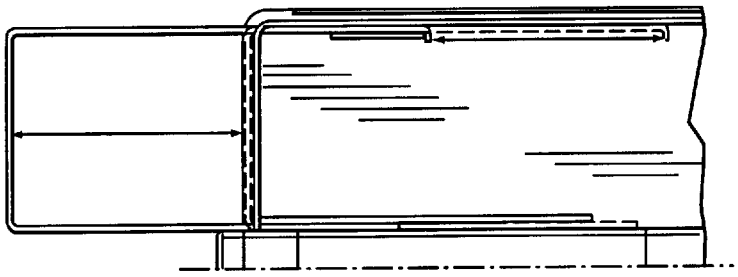
FIG. 4

SHEET MUSIC STAND

This application is a continuation in part of application Ser. No. 09/268,348 filed Mar. 16, 1999, abandoned.

FIELD OF THE INVENTION

This invention relates to collapsible stands of the type used by musicians to hold sheet music at a convenient height and orientation so that the musician can see the music while playing a musical instrument. The stand can be disassembled and packed as a self-contained structure.

BACKGROUND OF THE INVENTION

Although this invention will be described with reference to use by musicians, it will be evident that the invention can be used by anyone who wishes to display papers or a book at a convenient height and orientation.

Musicians use music stands to display two or three sheets of music while the musicians play various instruments. The stands usually allow for height adjustment so that the music can be placed at the most advantageous height as required by the musician, who could be in a sitting or standing position. Consequently, the structures must be designed to support the music at a variety of heights above a supporting surface, and also permit disassembly so that musicians can transport the stands along with musical instruments when travelling from engagement to engagement. Also, the structures cannot be flimsy or easily deformed because they must provide a stable support for the sheet music.

As a result of these design criteria, it would be advantageous if music stands were designed to be collapsible into a more convenient size for travelling. It would be a further advantage if the structure could be collapsed into a self contained package which is easily handled and stored. An example of a structure made with these features in mind is found in U.S. Pat. No. 5,692,719 to the present inventor. In that structure, the parts of the music stand can be partially disassembled and stored partly within one another before entry into a convenient carrying bag. It has been found that while the structure taught in U.S. Pat. No. 5,692,719 is acceptable, it would be preferable to make the music stand totally self contained after it is collapsed. Such a structure must also have sufficient rigidity when assembled to display the sheet music without undue flexibility sufficient to affect the use of the sheet music by the musician.

SUMMARY OF THE INVENTION

In one of its aspects the invention provides a collapsible music stand made up of a music support and a base. The music support has rectangular first and second platens and a hinge disposed about a hinge axis and coupling the first and second platens along adjacent longer sides. The first and second platens are moveable about the hinge axis between a closed position in which the platens are parallel and an open position in which the platens are adjacent one another and coplanar for supporting the music. Each of the first and second platens includes respective peripheral walls extending about three sides of the respective platens and meeting when the platens are in the closed position to define a cavity within the support bordered by the peripheral walls and hinge. The base is releasably attachable to the music support and includes a telescopic post and legs releasably attachable to the post so that on assembly the base can be placed on a horizontal surface to carry the music support in a position to display sheet music. The telescopic post and legs are separable for storage in the cavity so that the base can be stored in the support with the first and second parts in the closed position thereby presenting a convenient package for carrying and storage.

In another of its aspects, the invention provides a collapsible stand of the type used to display sheet music for a musician and having a music support and a hinge disposed about a hinge axis and attached to the music support. A base is releasably attachable to the hinge, and the base has a telescopic post and legs releasably attachable to the post. On assembly the base can be placed on a longitudinal surface to carry the music support in a position to display sheet music and each of the legs has an end piece. The telescopic post extends about a post axis and has upper and lower ends and a coupling is attached to the lower end. The coupling defines longitudinally extending recesses, and each of the legs has a flange for engagement in a respective one of the recesses by moving the flange axially of the post towards the upper end of the post. This permits assembly and disassembly of the legs and the legs provide a firm support on assembly.

BRIEF DESCRIPTION OF THE DRAWINGS

FIG. 1 is a perspective view of a preferred embodiment of the music stand according to the invention and shown in an assembled condition ready for use;

FIG. 3 (drawn adjacent FIG. 1) is a sectional view of a portion of the music stand on line 3—3 of FIG. 1;

FIG. 4 (drawn adjacent FIG. 1) is a view looking from under the music stand to illustrate extensions used when three sheets of music are to be supported, and showing part of the music stand;

DESCRIPTION OF THE PREFERRED EMBODIMENT(S)

Figure 2:
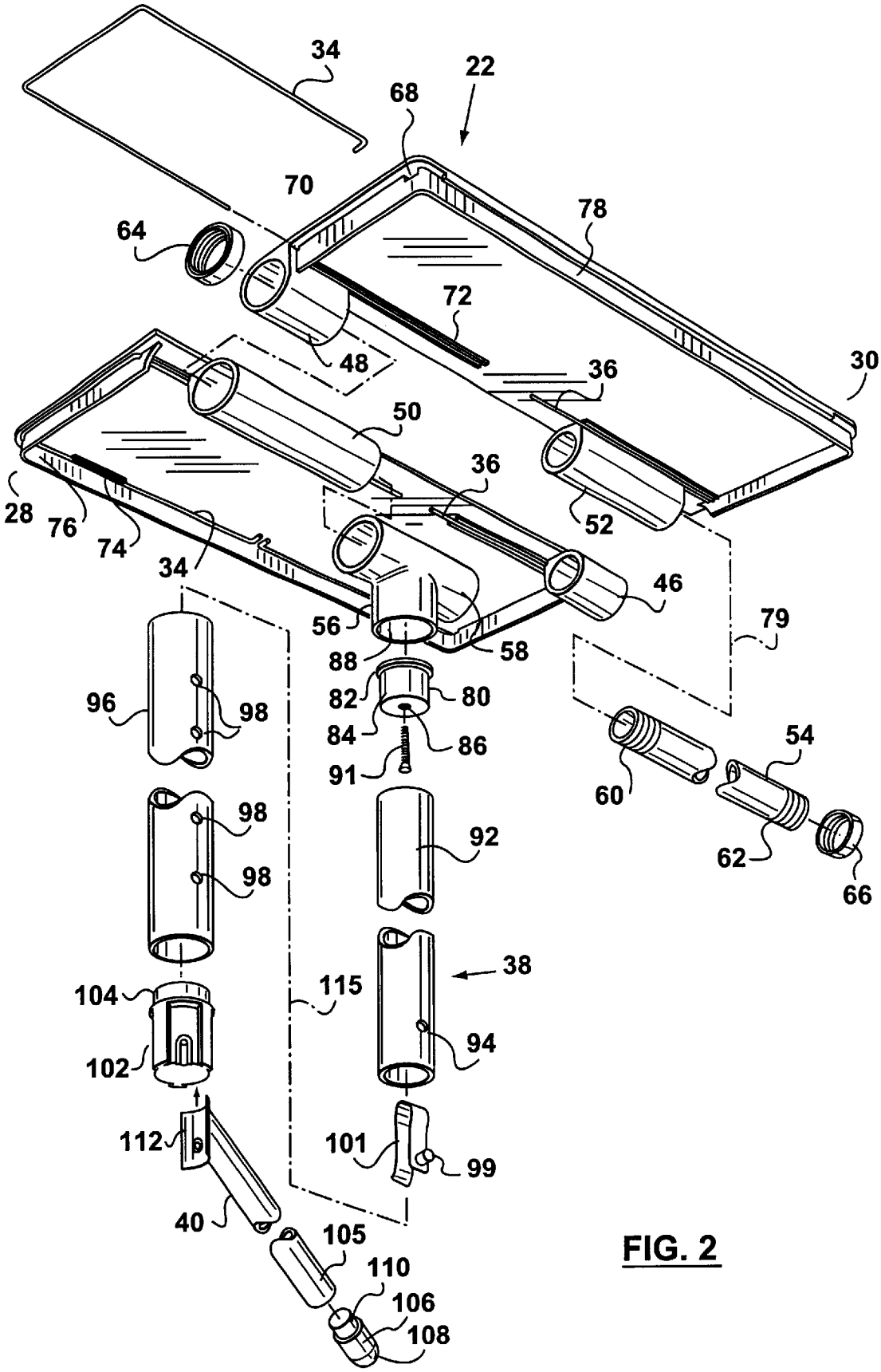
FIG. 2 is a partial exploded view of the music stand also shown in a perspective and illustrating the assembly of parts of the music stand.

Reference is first made to FIG. 1 which illustrates a collapsible music stand designated generally by the numeral 20 and consisting essentially of a music support 22 and a base 23 under the music support. Music (indicated in ghost outline at 24) can be displayed on a surface made up of first and second platens 26, 27 forming respective parts of similar first and second parts 28, 30 which are connected at a hinge 32. The surface would normally support two sheets of music but in situations where three are used, extensions 34, 36 can be pulled out of the ends of the respective parts 28, 30 to provide further support. The overall size of the support 22 is then equivalent to about 3 sheets of music. The height of the music support can be changed by use of a telescopic post 38 forming part of the base 23 and the post is supported on three legs 40, 42 and 44. The angle of the music and the height of the music can be changed by use of the adjustable hinge 32 and the telescopic post 38 as will become apparent from the following description.

As seen in FIG. 2, the first and second parts 28, 30 are similar in shape and include respective pairs of barrels 46, 48 and 50, 52. When the barrels are in alignment with one another and positioned with longer sides of the rectangular parts 28, 30 adjacent one another, the platens 26, 27 are coplanar (FIG. 1) and a hinge pin 54 can be engaged through the barrels and at the same time through a T-shaped connector 56 which has a tubular upper part 58 corresponding in shape to the barrels and of a length to fit between the barrels 50 and 52. With the hinge pin in place it will be appreciated that the parts 28, 30 are located relative to one another and the connector 56 is in position to receive the telescopic post 38 as will be described.

The hinge pin 54 has threaded ends 60, 62 for receiving end fittings 64, 66. These end fittings are in the form of threaded rings so that with the hinge pin in place, the rings project (as seen in FIG. 1) and are available for manual operation to tighten the fittings against the respective barrels 48, 46 which causes slight movement axially along the axis of the pin 54 sufficient to create frictional engagement between the barrels 46, 48, 50, and 52 and the upper part 58 of the T-shaped connector 56. Consequently by applying a load on the end fittings 64, 66 the music support 22 can be fixed in an open position ready to receive music as shown in FIG. 1 or in a closed or stored position as will be described with reference to FIGS. 8 and 9.

It can also be seen in FIG. 2 that the four extensions 34, 36 are moveable between the deployed position shown in FIG. 1 and a stored position as indicated by one of the extensions 34 and the two extensions 36. The second extension 34 is shown in FIG. 2 before assembly. It will be evident by a comparison of the extensions in FIG. 2 that the extension 34 can be engaged through suitable openings 68, 70 and then run in a guide 72 and a locating structure such as structure 74 shown in association with the other of the extensions 34. This is also seen in FIG. 3. The guide 72 is proportioned so that the extension 34 is a sliding but frictional fit to locate the guide and prevent accidental movement. Similar structures are provided for the other extensions.

Figure 9:
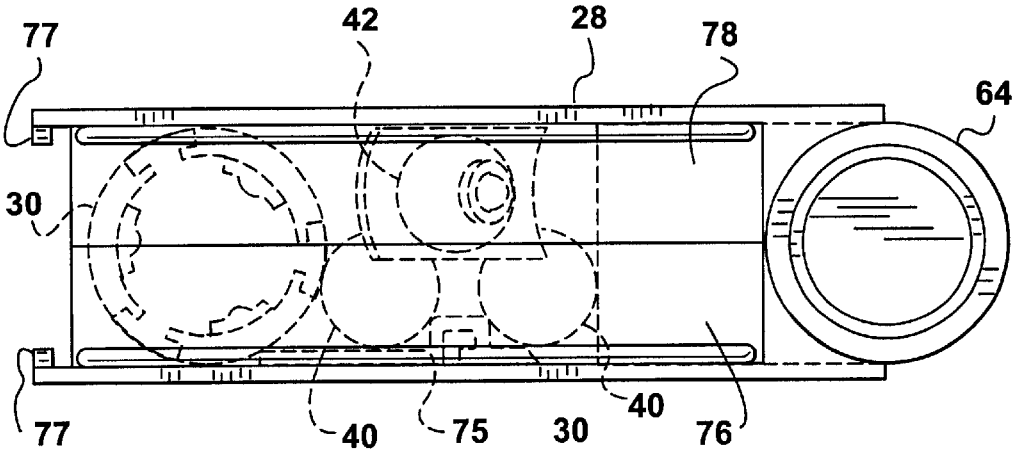
FIG. 9 is an end view of the music stand after it has been collapsed and placed in the stored position.

The first and second parts 28, 30 include respective peripheral walls 76, 78 extending about three sides of the respective rectangular first and second parts 28, 30 and proportioned to meet when the parts are rotated about an axis 79 of the hinge pin 54 to bring the structure into a closed or stored position as seen in FIG. 9. This will be more fully described with reference to FIGS. 8 and 9.

Reference is next made to FIG. 4 which is a cross section at 4—4 of FIG. 1 and shows a removable fence 75 which can also be seen in FIG. 1. The fence is an extended structure shaped to fit about a lip 77 on the exposed lower edge of the second part 30. The lip 77 is shaped outwardly from and parallel to the peripheral wall 78 to engage in a suitably shaped channel 81 in the fence. As a result the fence can be slipped longitudinally on to lip 77 to take up the position shown in FIG. 1 where the fence prevents the music 24 from sliding off the platen 26.

As also seen in FIG. 2, the telescopic post 38 (which is shortened for drawing purposes) includes a plug 80 having a loading collar 82 and a smaller boss 84 with a central through opening 86. The boss fits inside a tubular extension 88 so that there is an annular space between the boss 84 and the extension 88 for receiving a first end of an upper tube 90 of the post 38. The axis of the tubular extension 88 is at right angles to the axis of the tubular upper part 58 and a screw 91 is provided for engagement through the opening 86 to be threaded into the hinge pin 54 thereby simultaneously retaining the plug in position in the extension 88 and the hinge pin 54 in the barrels 46, 48 and 50, 52. The hinge pin is then fixed so that it will not rotate when the end fittings 64, 66 are used when tightening the barrels against one another to locate the first and second parts about the axis of the hinge pin 54.

Figure 5:
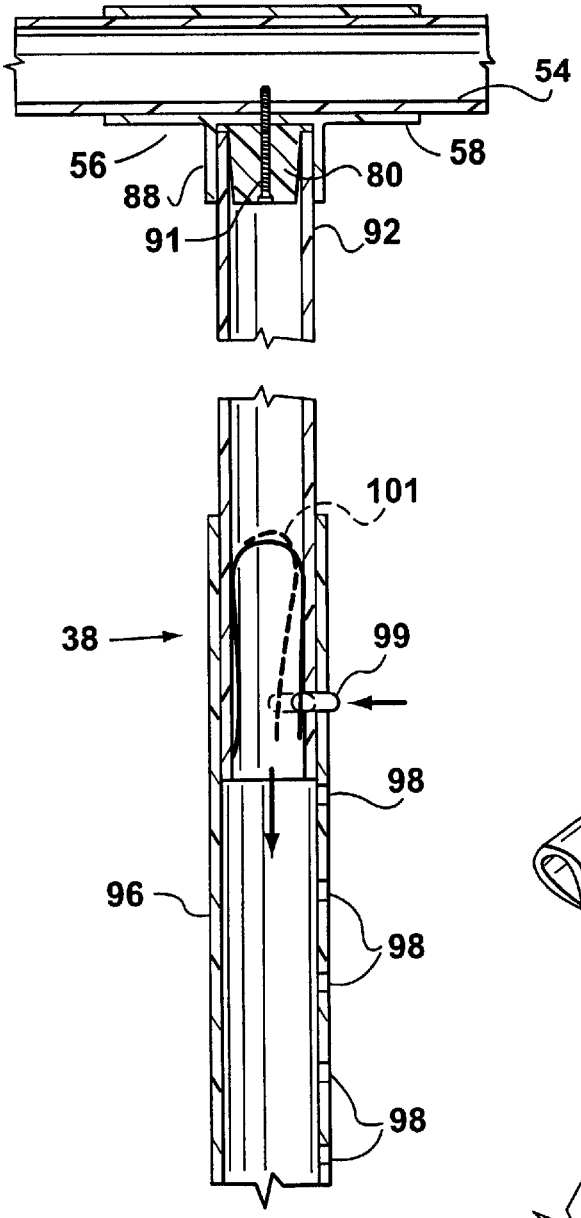
FIG. 5 is a sectional view on line 5—5 of FIG. 1 and illustrating details of the assembly of the music stand.

Reference is next made to FIG. 5 which better illustrates the assembly of the parts that have just been described with reference to FIG. 2. It will be seen that the plug 80 combines with the connector 56 and in particular, with the tubular extension 88, to provide a seat for an upper end of the upper tube 92. It can also be seen in FIG. 5 that the screw 91 passes through the plug 80, through the wall of the upper part 58 of the connector 56 and is threadably engaged in the wall of the hinge pin 54.

Returning to FIG. 2, it will be seen that the upper tube 92 includes a side opening 94 near the bottom end of the tube. This tube receives a larger lower tube 96 which is a telescopic fit on the upper tube and which cooperates with the upper tube to change the height of the post. This is achieved by providing a series of openings 98 in the lower tube for alignment with opening 94 so that a button 99 attached to a U-shaped leaf spring 101 can be engaged through opening 94 into a selected one of the openings 98. This is better seen in FIG. 5 where the shape of the leaf spring is evident. The leaf spring is shaped to be in tension when it is pushed into the tube so that the button 99 is urged outwardly at all times. To change the height of the post, a user would push the button 100 sufficiently to move it through one of the openings 98 so that the tubes can then be moved longitudinally relative to one another until the button finds another opening 98 to again locate the tubes. If it is desired to move the tubes some distance they can be rotated slightly before moving so that the pin will not accidentally find its way into one of the openings 98.

The bottom end of the lower tube 96 receives a socket member 102 having an upper boss 104 shaped to fit securely and permanently in the bottom end of the lower tube 96. The socket member 102 receives the legs 40, 42, 44 (FIG. 1) and in this view leg 40 is shown. The leg is a tubular element with a bottom plug 106 having an anti skid foot 108 and a boss 110 at the other end for permanent engagement in the tubular element 105.

Figure 6:
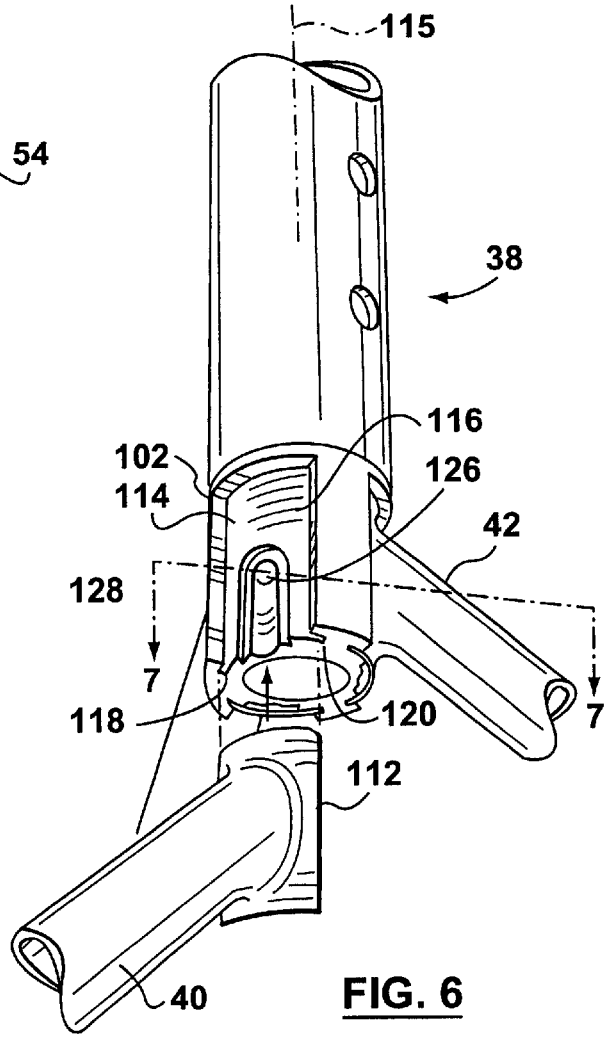
FIG. 6 is a perspective view illustrating the engagement of a leg into a post.

At the upper end of the tubular element, a shaped flange 112 is provided which, when assembled, has a cylindrical curvature about a post axis 115. The flange 112 and associated structure is better seen in FIG. 6 where the leg 40 is about to be engaged in the socket member 102 and the leg 42 is already in place. The element 102 has three sockets, one for each leg and a socket 114 is typical of all three sockets. The socket consists of a recess 116 extending axially with respect to the post axis 115 and bordered by longitudinally extending slots 118 and 120. These slots are proportioned to receive sides of the flange 112 so that with the flange fully engaged, the leg 40 is located positively with respect to the socket member 102 and hence to the post 38.

Figure 7:
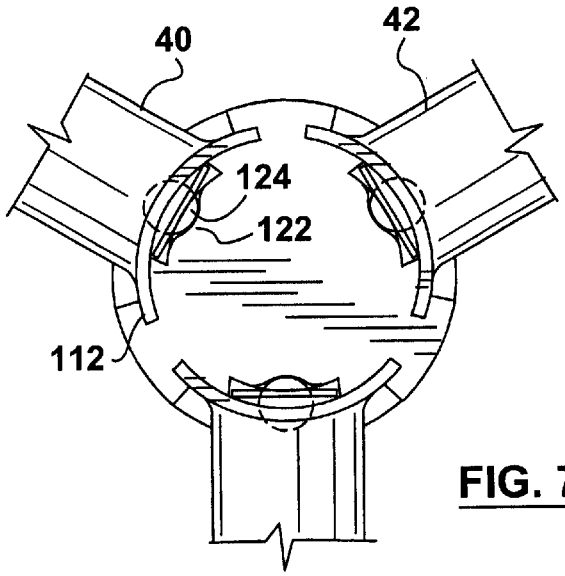
FIG. 7 is a sectional view on line 7—7 of FIG. 6 and illustrating the interconnection between the legs and the post on assembly.

The leg 40 is also retained in the socket member 102 by a ball catch 122 seen in FIG. 7. This consists of a conventional ball in a housing with a spring behind it and the complete assembly is engaged in an opening formed through the flange 112 so that the ball catch is permanently engaged. A spring biased ball 124 projects sufficiently to engage in a suitable recess 126 (FIG. 6) at the upper end of a axial channel 128 along which the ball 124 travels before snapping into position in the socket 126. When the leg is removed, it is simply pulled axially downwards to cause the ball to move out of engagement with the socket and travel down the channel 128. As a result, the legs can be positively engaged in the socket 102 and yet removed relatively easily.

Figure 8:
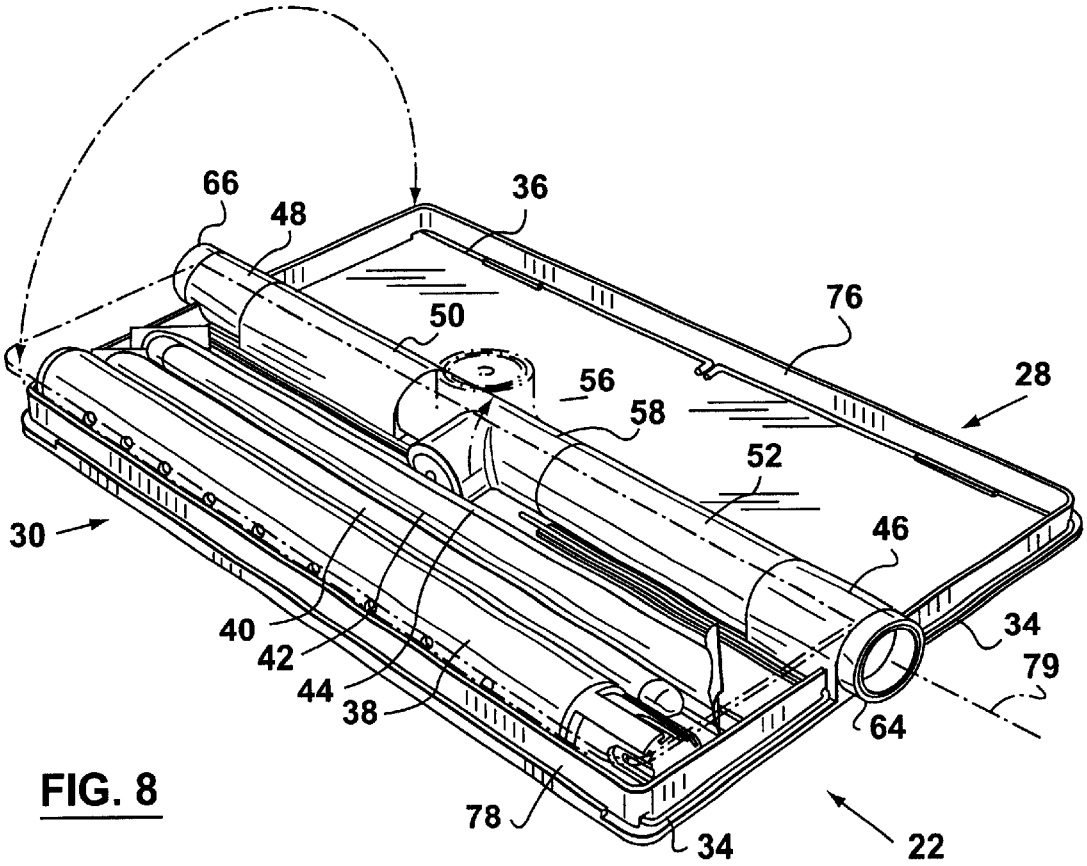
FIG. 8 is a perspective view illustrating the music stand after it has been collapsed and ready to complete storage.

Reference is next made to FIGS. 8 and 9 to illustrate how the music stand is collapsed into a stored position. As seen in FIG. 8, the telescopic post 38 has been adjusted into its shortest length and removed from the music support 22 by simply disengaging the post from the connector 56. Referring to FIGS. 8 and 9 it can be seen that to store the stand 20, the telescopic post 38 is first placed inside the first part 30 adjacent the peripheral wall 78 with the connector 56 rotated about the hinge axis 79 to bring the tubular extension 88 into engagement with the second part 30 as seen in FIG. 8. Next the fence 75 is extended side-by-side with the post 38, and the legs 40, 42 and 44 are then placed on top of the fence with the top leg 42 reversed lengthwise relative to the other legs 40, 44. The first and second parts 28, 30 are then moved about the hinge axis 79 to bring the peripheral walls 76, 78 into engagement to close the stand in the storage position. The end fittings 64 and 66 are then tightened to retain the stand 20 in the closed position.

When the music stand 20 is to be used, the end fittings 64, 66 are released slightly so that the first and second parts can be moved about the hinge axis 79 into the open position shown in FIG. 8. The post 38 is removed and legs 40, 42 and 44 assembled in the manner described with reference to FIGS. 6 and 7. Next the legs are placed on a supporting surface so that the post 38 is upright and ready to receive the music support 22 (FIG. 1) as seen in FIG. 5. The music support 22 is then positioned relative to the horizontal with the parts 28, 30 defining the platen 26 and the end fittings 64, 66 are tightened to lock the parts 28, 30 to the connector 56 thereby setting the orientation of the platen 26. Lastly, the fence 75 is added.

The assembled music stand 20 can be adjusted vertically using the button 99 (FIG. 5) as previously described.

Figure 10:
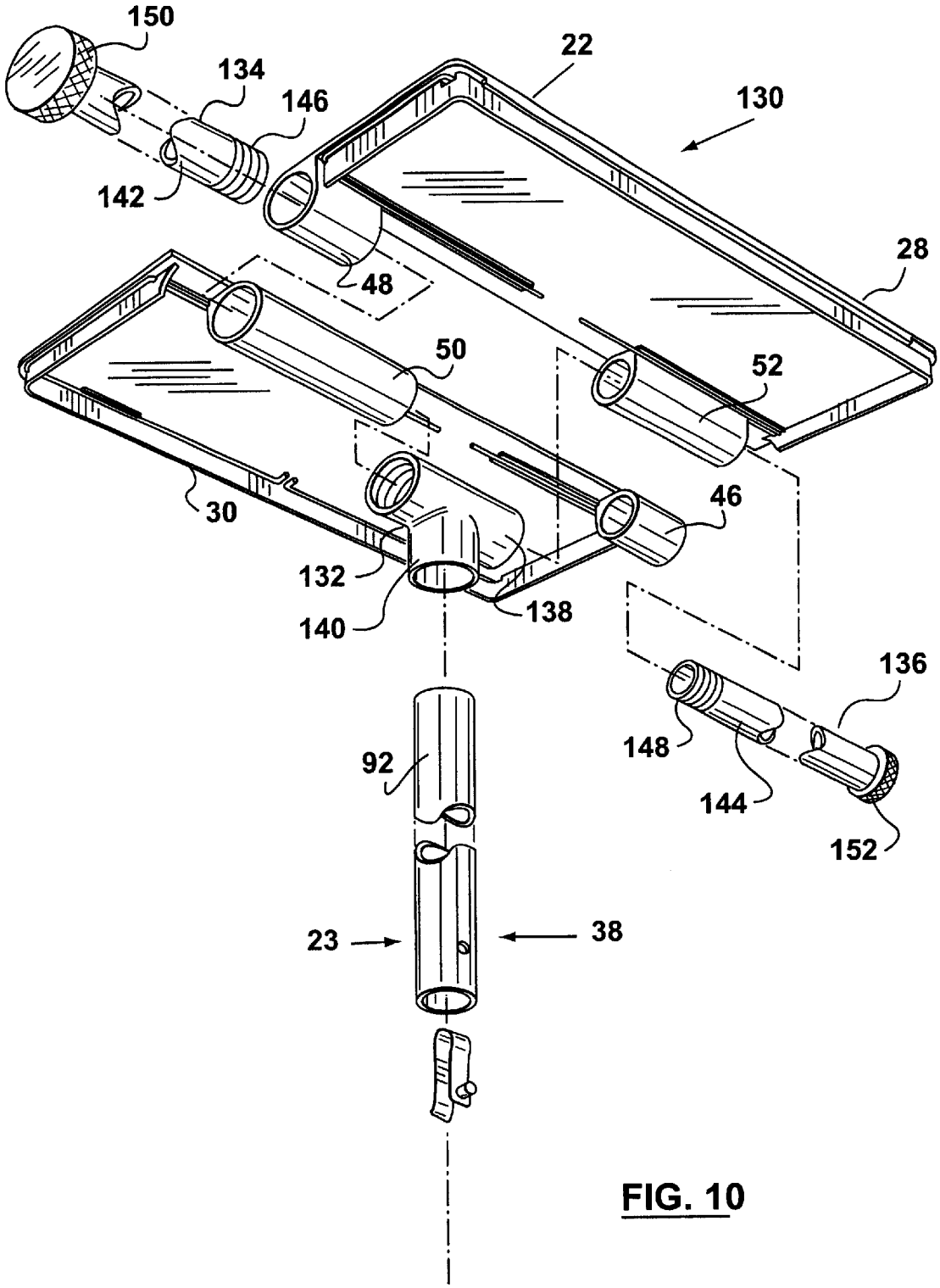
FIG. 10 is a view similar to FIG. 2 and illustrating an alternative embodiment of the music stand.

Reference is now made to FIG. 10 which illustrates an alternative embodiment of music stand according to the invention and indicated generally by numeral 130. This music stand includes the same platens 28, 30 as those previously described and also, the base 23 (only part of which is shown) is also the same as that described previously. However in this embodiment, a connector 132 is provided and the hinge pin is in the form of respective first and second sections 134, 136. It would also be evident by comparison with FIG. 2, that the plug 80 shown in FIG. 2 is not used in this second embodiment.

The connector 132 includes an upper part 138 which is tubular and has an internal thread. A tubular extension 140 (which is similar to extension 88 shown in FIG. 2) extends downwardly to receive an upper end of the tube 92. This tube is a sliding fit and does not require any further attachment because in use the music support 22 will remain in place under the influence of gravity.

The anchor pin sections 134, 136 are similar and consist of respective tubular elements 142, 144 which are threaded at leading ends 146, 148 and have attached collars 150, 152 at the outer ends. They are proportioned so that on engagement through the barrels 46, 48 and 50, 52, they can be threaded into the upper part 130 of the connector 132 so that the collars 150, 152 are brought into engagement with the respective barrels 46, 48 to apply the compressive load as previously described. The user would normally hold both collars 150,152 and apply a turning moment to drive them into position. Similarly, the structure can be released by turning the collars in the opposite direction.

Figure 11:
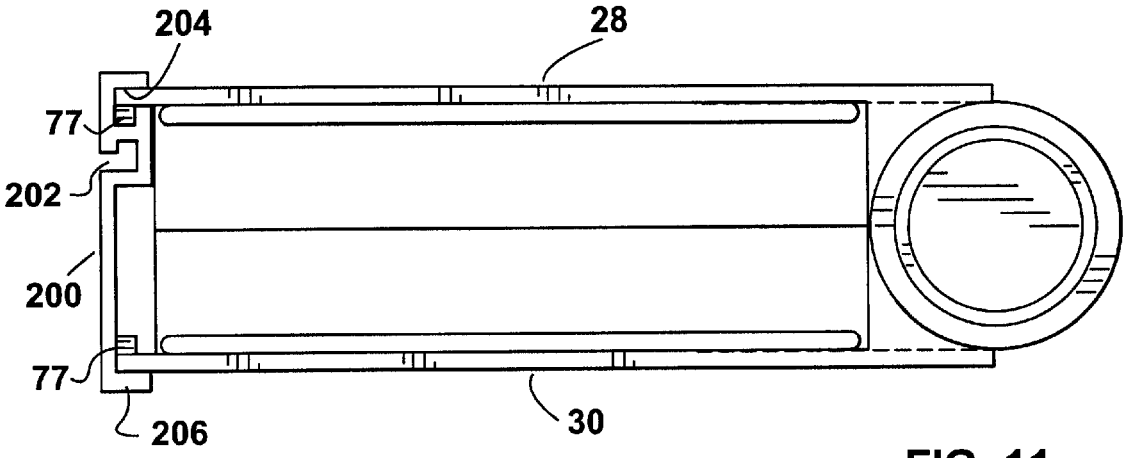
FIG. 11 is a view similar to FIG. 9 and showing another embodiment of fence used to hold the structure in a closed position.

Reference is next made to FIG. 11 which illustrates the embodiment illustrated previously in FIG. 9 with the exception that a fence 200 is added. This fence 200 will function like the fence 75 shown in FIGS. 1 and 3 but also has the added function that it can be used as a closure for the structure. This is achieved by providing both an outwardly facing L-shaped channel 202 (which corresponds to the channel 81 in fence 75, as seen in FIG. 3) and a similar inwardly facing channel 204 having a reversed orientation with respect to the channel 202. This allows the fence 200 to be attached to the lip 77 on one of the parts 28, 30 (FIG. 1). As drawn, the fence 200 is attached to the part 28 and extends towards the part 30 with the structure in the closed position. The fence maintains the structure in a closed position using an edge flange 206 which is positioned to fit snugly about the part 30 adjacent the corresponding lip 77.

The fence 200 is engaged on the lip 77 using the channel 202 when the structure is assembled to support music so that the fence then stands upwardly from the corresponding platen 26 or 27. After disassembly, the fence is slid longitudinally off the part 28 or 30 and then the components of the structure are stored in the cavity between the platens before the fence 200 is assembled using one of the lips 77 in the position shown in FIG. 11.

This structure has two main advantages. Firstly the fence becomes an integral part of the disassembled structure rather than another part to store, and secondly, the fence provides a positive lock without the need to adjust the collars 150, 152 (FIG. 10) or their equivalents. As a result the collars can be left in a preferred condition where they stabilise the platens but allow the structure to be disassembled against the friction in the hinge.

Figure 12:
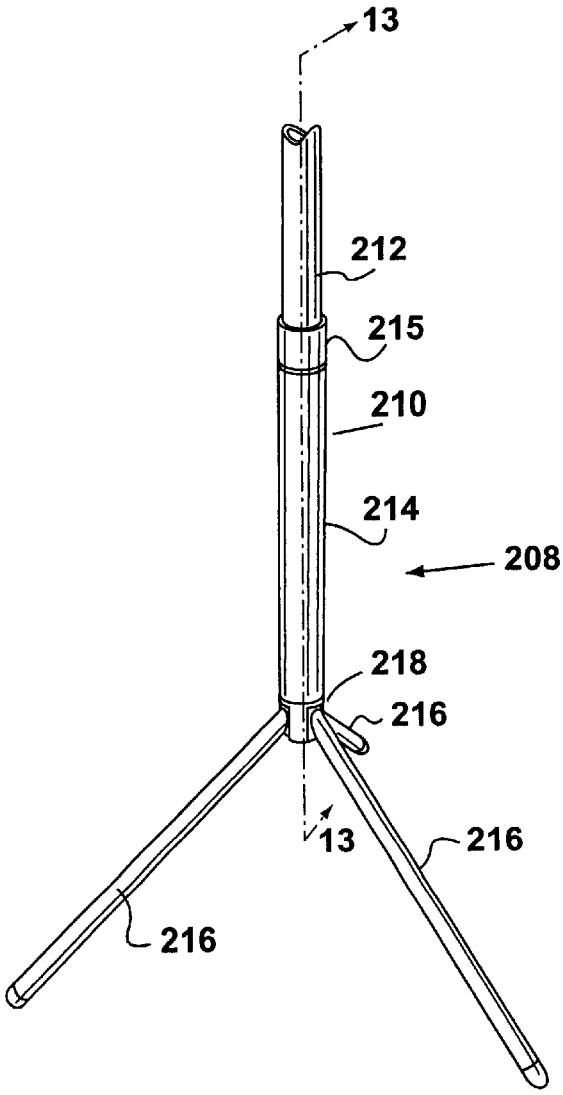
FIG. 12 is a an isometric view illustrating another embodiment of base for use in the music stand.

Reference is next made to FIG. 12 which illustrates another embodiment of base 208 which will attach to a music support such as that shown in FIG. 10. A telescopic post 210 consists of upper and lower tubes 212 and 214 with a collet chuck 215 attached to the tube 214 and operable to grip the tube 212 in a selected position within the range of lengthwise movement of the tubes relative to one another. Details of the chuck will be described with reference to FIG. 13.

The base 208 also includes three legs 216 which are a sliding fit into a socket member 218. This member is somewhat similar to the member 102 (FIG. 6) but differs in detail as will be described with reference to FIGS. 13 and 14.

Figure 13:
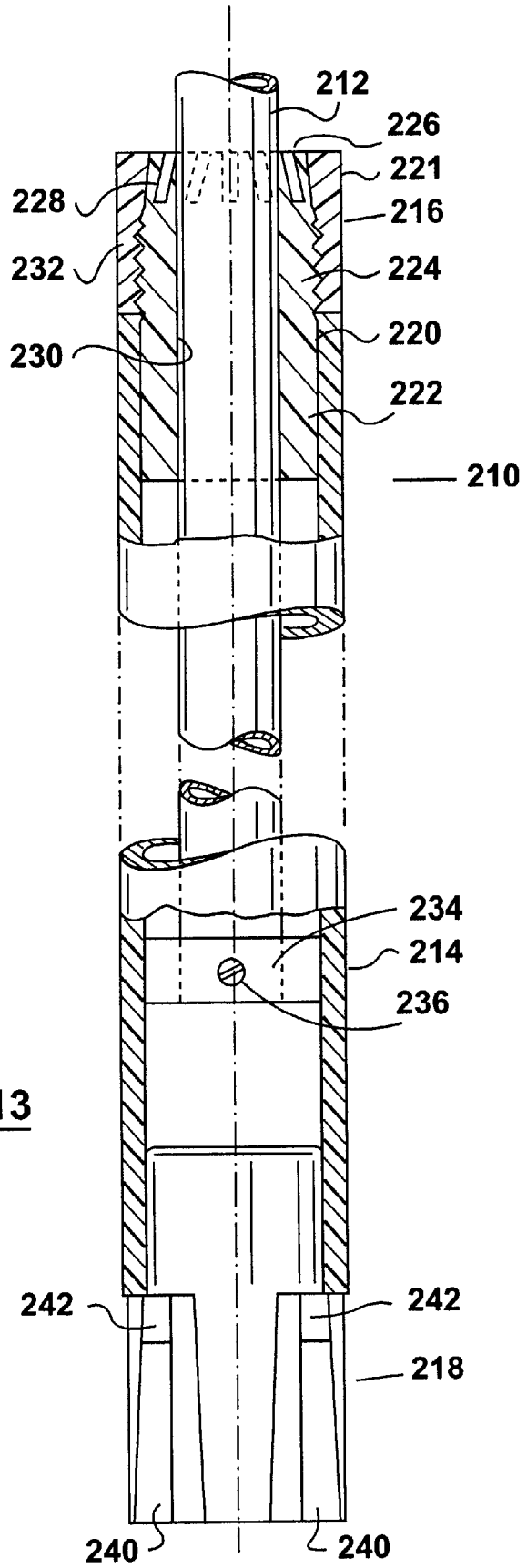
FIG. 13 is partial sectional view on line 13—13 of FIG. 12.

As seen in FIG. 13, the tube 212 is somewhat smaller in diameter than the tube 214 in order to accommodate the chuck 215 between them. The chuck 215 is of the collet type having an inner tubular section 220 fixed in the outer tube 214 and an outer tubular lock ring 221. The section 220 has a cylindrical end portion 222 in the tube 214, a threaded intermediate portion 224, and a tapered end portion 226 having axial slots 228 arranged to permit flexing of the portion 226 radially. All three portions 222, 224, and 226 have a common central bore 230 providing a sliding fit for the inner tube 212.

The lock ring 221 includes a threaded portion 232 to draw the ring 221 axially into engagement with the section 221 and an inwardly tapered portion shaped to deflect the end portion 226 inwardly into contact with the inner tube to frictionally lock the tubes 212, 214 together at a height chosen by the user. To adjust the height the collet chuck 215 is released and the tubes moved lengthwise before again fastening the chuck 215.

It will also be seen in FIG. 13 that the tube 212 ends at a collar attached by a set screw 236 to the lower end of the inner tube 212. the collar 234 is proportioned to be a sliding fit in the tube 214 so that the collar cooperates with the bore 230 in the collet chuck 215 to maintain the inner tube 212 concentric with the outer tube. Also the inherent friction built into the parts ensures a smooth action and there is sufficient friction to maintain the height of the telescopic 210 post while it is locked in place.

Figure 14:
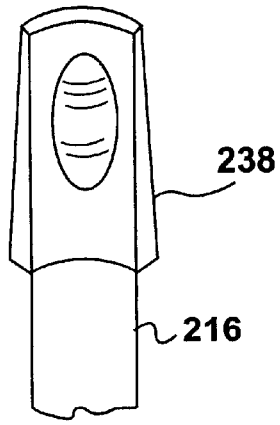
FIG. 14 is an end view of a leg used in the embodiment shown in FIG. 13.

FIGS. 13 and 14 illustrate another variation to the structures described previously. The legs fit into the socket member 218 and stay in place due to frictional contact only. Because the stand is supported by the legs there is little likelihood that they will be dislodged during use. As seen in FIG. 14, each leg has a flange 238 which is similar to the flange 112 seen in FIG. 6. However the flange 238 is tapered such that it is slightly narrower at the top than at the bottom. Also the flange has a thickness which decreases upwardly. The member 218 seen in FIG. 13 has three recesses 240 (two of which can be seen in FIG. 13) shaped to receive the respective flanges 238 on the legs 216. The recesses are tapered generally to match the shapes of the flanges with pads 242 provided to give the last part of the sliding engagement a friction fit to ensure that the legs stay in place after engagement. These pads are optional. At this point the flanges 238 are fully engaged in the corresponding recesses and the legs are a rattle-free fit. This gives a very reliable yet simple structure which relies on accuracy of manufacture and needs no additional parts.

It will be appreciated that changes can be made to the preferred embodiment without departing from the invention. Such changes are within the scope of the invention as claimed.

What is claimed is:

1. A collapsible stand of the type used to display sheet music for a musician, the stand including:

a music support having rectangular first and second parts, the parts including respective first and second platens;

a hinge disposed about a hinge axis and coupling the first and second parts along adjacent longer sides, the first and second parts being movable about the hinge between a closed position in which the platens are parallel and an open position in which the platens are adjacent one another and coplanar for supporting the sheet music, and each of the first and second parts including respective peripheral walls which meet when said parts are in the closed position to define a cavity within the support bordered by the peripheral walls and the hinge;

the hinge further including barrels, each of the barrels being attached to one of the first and second parts, and a hinge pin passing through the barrels, the barrels being arranged to secure said parts to the hinge pin, and the hinge in being in two sections, each of the two sections having an outer collar and a threaded inner end; and a connector having a top portion for threadably receiving the respective inner ends of the sections of the hinge pin and a tubular extension releasably engageable with the upper end of the post for assembly and disassembly whereby the first and second parts can be locked in a selected position relative to the hinge by turning the sections of the hinge pin to apply compressive loading to the barrels;

a base releasably attachable to the support, the base having a telescopic post and legs releasably attachable to the post so that on assembly the base can be placed on a horizontal surface to carry the music support in a position to display sheet music; and the telescopic post and the legs being separable for storage in said cavity whereby the base can be stored in the support with the first and second parts in said closed position.

2. A stand as claimed in claim 1 in which the first and second parts are similar.

3. A stand as claimed in claim 1 in which the stand includes three legs, each of the legs having a flange at an end of the leg, and the telescopic post extending about a post axis and having upper and lower ends and a socket member attached to the lower end, the flanges being releasably engageable in the socket member for assembly and disassembly of the stand.

4. A stand as claimed in claim 3 in which the flanges are moved axially relative to the post axis to engage and disengage the socket member.

5. A collapsible stand as claimed in claim 1 in which the parts are similar.

6. A collapsible stand as claimed in claim 1 and further comprising a fence releasably attachable to a selected one of the first and second parts to border the associated one of the first and second platens remote from the hinge to prevent the music sliding off the music support when the support is tilted in use.

7. A collapsible stand as claimed in claim 6 in which the fence is attachable to one of the first and second parts with the first and second parts in the closed position, and includes an edge flange to engage the other of the first and second parts in the closed position.

* * * * *